United States Patent [19]

Anders et al.

[11] 4,103,268

[45] Jul. 25, 1978

[54] DUAL COIL HINGED BOBBIN ASSEMBLY

[75] Inventors: Raymond H. Anders, Madison; William F. Wernet, Huntsville; Gerald W. Foster, Somerville; Ronald C. Ward, Huntsville, all of Ala.

[73] Assignee: GTE Automatic Electric Laboratories Incorporated, Northlake, Ill.

[21] Appl. No.: 811,027

[22] Filed: Jun. 29, 1977

[51] Int. Cl.[2] ..... H01F 27/30; H01F 41/06

[52] U.S. Cl. ..... 336/208; 29/605; 242/118.41

[58] Field of Search ..... 336/198, 208; 29/605, 29/602; 242/118.41; 335/299; 310/194

[56] References Cited

U.S. PATENT DOCUMENTS

| | | | |
|---|---|---|---|
| 3,689,862 | 9/1972 | Hilgers | 336/198 X |
| 3,958,328 | 5/1976 | Lee | 29/605 |

*Primary Examiner*—Thomas J. Kozma

[57] ABSTRACT

A dual coil bobbin assembly adapted for use in the manufacture of coil elements for telephone receivers comprising two spool like sections joined by a flexible hinge and adapted to have the bobbins of each coil positioned axi-symmetrically on a temporary basis whereby both coils maybe mechanically wound on the bobbin assemblies. After winding is completed the coils may be repositioned with each bobbin parallel and in appropriate position for mounting in a telephone receiver assembly.

8 Claims, 8 Drawing Figures

DUAL COIL HINGED BOBBIN ASSEMBLY

BACKGROUND OF THE INVENTION

1. Field of the Invention

This invention relates to telephone receivers; and more particularly to a dual hinged bobbin coil form adapted for mechanical winding of coils thereon for use in telephone receiver assemblies.

2. Description of the Prior Art

Telephone receiver units both currently and in the past have been largely electromagnetic transducers. In most conventional designs dual coils are employed in the electromagnetic structures that form a part of such receivers. Currently such coils are wound on light weight plastic bobbins and present a number of manufacturing problems.

In high volume production manufacturing of such coils it has been desirable to machine wind the wire employed for the coils on plastic bobbins. In the past two separate bobbins requiring a third plastic jig to hold the two bobbins together in an axi-symmetric position for winding have been employed. In this manner a continuous piece of wire is employed for the winding of both coils. This previous arrangement resulted in a high scrap rate due to tangling of wires, broken wires and defective windings. After the jig was removed, which held the coils together during the winding procedure, additional plastic parts were added to facilitate assembly to the receiver unit.

The winding of two coils separately and then joining the wires together and retaining the coils by a common fixture is taught by U.S. Pat. No. 3,243,752. Such an arrangement because of the additional assembly time and winding time involved is not a desirable solution in the telephone receiver coil manufacturing procedure. A solution to the winding of two coils with a single piece of wire is taught in U.S. Pat. No. 3,675,174. However here two separate coils are employed which are then manually joined in an axi-symmetric relationship to permit a single continuous wire to be wound on the first bobbin and then on the second bobbin by mechanical means. Once separated for repositioning in a parallel relationship such as employed in telephone receivers, the fragile wire may be easily broken. In the referenced patent the dual coil unit is incapsulated providing the necessary protection and rigidity, but only after winding is complete. Such an arrangement is not readily adaptable to dual coils as utilized in telephone receivers.

It is the object of the present invention to provide a new and useful dual coil bobbin structure for use with telephone receivers that permits mechanical winding of both coils with a single piece of wire while overcoming the above outlined drawbacks of prior art techniques.

SUMMARY OF THE INVENTION

The present invention is drawn to a dual coil bobbin assembly for use in telephone receivers which includes two plastic bobbins joined by a plastic hinge assembly adapted to be folded or bent in such a manner as to place both bobbins along the same axis whereby coils may be wound on both bobbins mechanically in a single operation and with a single piece of wire. After winding the assembly can be unfolded and returned to its initial position with both coils parallel to each other and ready for use directly in the assembly operation of the telephone receiver.

Included on a flange of each of the bobbins is a pin and a socket positioned to engage a corresponding pin and socket on the other bobbin in such a manner as to hold the assembly in an axi-symmetric configuration during winding. Also included on each bobbin assembly are spacer posts which serve as wire guides for the final assembly, standoff posts for use during receiver assembly, interbobbin wire guides useful for directing the wire between bobbins and interference ribs extending between the interlocking posts, also utilized during the final receiver assembly. Additionally included in each bobbin is an end tab useful for terminating the wires after winding.

The bobbin is initially molded of plastic, in a position corresponding to that in which it will be finally assembled. The entire assembly consisting of hinges and bobbins is molded as a complete assembly.

DESCRIPTION OF THE PREFERRED EMBODIMENT

Figure 1:
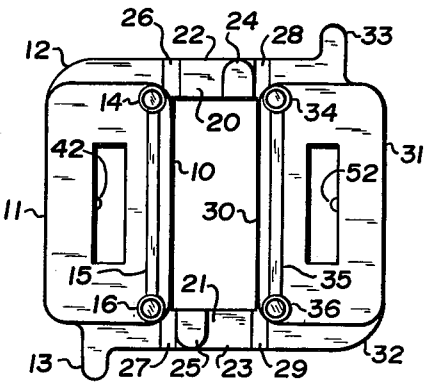
FIG. 1 is a top view of a dual bobbin assembly in the normal position in accordance with the present invention.

FIGS. 1, 2, 3 and 4 show the dual bobbin assembly of the present invention in its normal or upright position as the part is molded and also with the bobbins in the same relationship as after the coils are wound upon the bobbin units. Referring first to FIG. 1, the dual bobbin assembly of the present invention includes two hollow bobbins 10 and 30 joined together by hinge sections 20 and 21 respectively. As may be readily apparent by reference to FIGS. 1 and 2 hinge section 20 is joined by means of hinge 26 to the lower flange 12 of bobbin 10 and by means of hinge 28 to lower flange 32 of bobbin 30. Hinge section 21 is joined by hinge 27 to lower flange 12 of coil 10 and by means of hinge 29 to flange 32 of coil 30.

Bobbin 10 also includes an upper flange 11 on which are included on the exterior or top side thereof standoff posts 14 and 16 joined by rib 15. Corresponding structures for coil 30 are standoff posts 34 and 36 joined by rib 35 all located on upper flange 31. Visible also in FIG. 1 are end tabs 13 and 33 which are projections on lower flanges 12 and 32 respectively. Hinge section 20 further includes inter bobbin wire guide 24 while hinge structure 21 includes inter bobbin wire guide 25.

Figure 2:
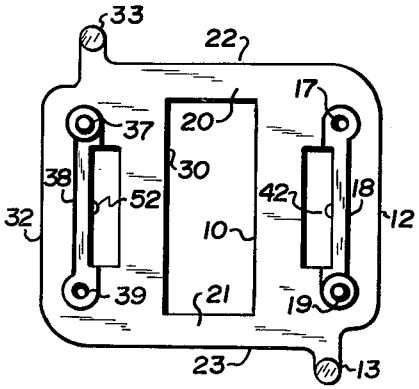
FIG. 2 is a botton view of a dual bobbin assembly in the normal position in accordance with the present invention.

Referring to FIG. 2, mounted on the exterior or bottom side of flange 12 or coil 10 are interlocking spacer posts 17 and 19 and interference rib 18 extending therebetween. Mounted on the exterior side of flange 32 are interlocking spacer posts 37 and 39 and interference rib 38 extending therebetween.

Figure 3:
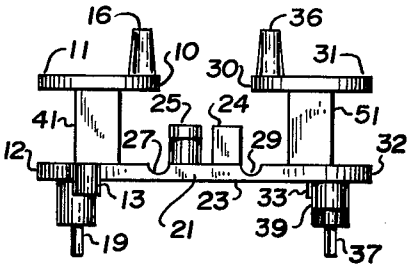
FIG. 3 is a front view of a dual bobbin assembly in the normal position in accordance with the present invention.
Figure 4:
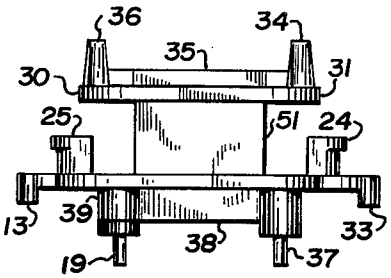
FIG. 4 is a right side view of a dual bobbin assembly in the normal position in accordance with the present invention.
Figure 5:
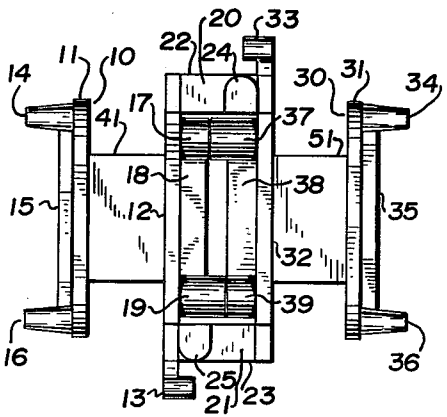
FIG. 5 is a top view of a dual bobbin assembly in the the folded position in accordance with the present invention.
Figure 6:
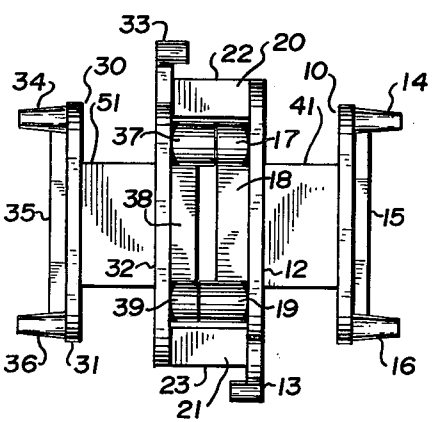
FIG. 6 is a bottom view of a dual bobbin assembly in the folded position in in accordance with the present invention.

Interlocking spacer posts 19 and 37 are of the male type and include projecting pin sections as may be seen by reference to FIGS. 3 and 4. Interlocking spacer posts 17 and 39 are of the female type and include an opening therein. Post 17 is adapted to receive the pin portion of post 37 and post 39 is adapted to receive the pin portion of interlocking spacer post 19. Such engagement takes place when the dual bobbin assembly of the present invention is folded to facilitate wiring. The dimensioning of the pin portions of spacer posts 19 and 37 and the openings in posts 17 and 39 are dimensioned so as they provide a reasonably snug fit wherein once engagement has taken place the dual hinge assembly will be retained in the folded position. However the dimensioning is also such that with slight pressure exerted manually, the assembly can be returned to its normal or upright position. As may be seen in FIGS. 2 and 4 end tabs 13 and 33 each include a projecting portion to better facilitate anchoring of the wire ends of the coils to be wound on bobbin elements 10 and 30 of the dual bobbin assembly of the present invention.

Inter bobbin wire guides 24 and 25 are located on the connecting portions 22 and 23 of hinge sections 20 and 21 respectively. Both inter bobbin wire guides include a projecting portion as may be seen in FIG. 4 which aid during the winding procedure in providing proper guidance between bobbins, for the single piece of wire utilized in winding both coils after the first coil is wound and the wire must be conducted from the first coil to the second for winding.

The upper flange 11 and lower flange 12 of bobbin 10 are connected by hollow core section 41. Likewise upper flange 31 and lower flange 32 of bobbin 30 are connected by hollow core section 51.

Reference to FIGS. 5, 6, 7 and 8 show the dual bobbin assembly of the present invention in the folded position utilized during mechanical winding of the coils on bobbins 10 and 20 respectively. As may be seen in FIGS. 5 and 6 interlocking spacer posts 37 and 17 are shown in their engaged position as are interlocking spacer posts 19 and 39. The pin portion of posts 37 and 19 respectively are not visible because of their insertion in the receiving portion of posts 17 and 39 respectively.

Figure 7:
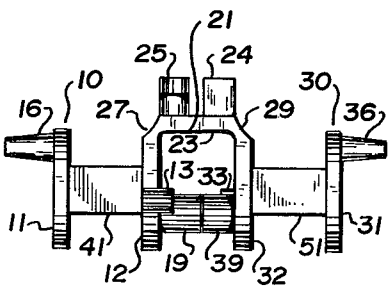
FIG. 7 is a front view of a dual bobbin assembly in the folded position in accordance with the present invention.
Figure 8:
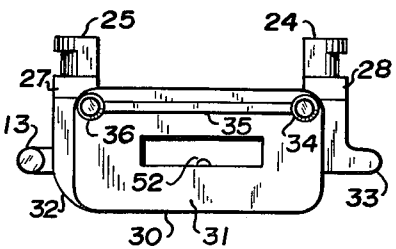
FIG. 8 is a right side view of a dual bobbin assembly in the folded position in accordance with the present invention.

As may be seen by reference to FIGS. 3 and 7 the hinge portions 27 and 29 of hinge assembly 21 because of their reduced cross section bend or fold to permit the reconfiguration of the dual bobbin assembly from its normal or upright position to the axi-symmetric position which permits mechanical winding of the coils on the bobbin structures 10 and 30 of the dual bobbin assembly.

In the present invention the use of dual hinge assemblies 20 and 21 permits the proper routing of wire from bobbin 10 to bobbin 30 without wire breakage or winding machine wire locating difficulties. The wire routing between the bobbins is achieved by the inclusion of inter bobbin wire guides 24 and 25 which keep the wire out of the center portion reserved for the magnet structure during final assembly to a telephone receiver unit. The dual interlocking spacer posts 17, 19, 37 and 39 insure the proper parallelism of the two bobbin sections 10 and 20 when folded for winding. The four interlocking spacer posts 17, 19, 37 and 39 also assist in locating the bobbin assembly in the proper position on the telephone receiver frame during assembly. Ribs 42 and 52 which extend into the bobbin cores 41 and 51 permit a slight friction fit which allows for more positive positioning during assembly of the receiver unit.

In at least one embodiment of the present dual bobbin assembly the entire unit is a single molded plastic design with the dual folding hinges achieved by reducing the cross section of the hinge portions connecting the two bobbin elements. The interlocking spacer posts 17, 19, 37 and 39 also function as wire guides during the final assembly while the standoff posts 14, 16, 34 and 36 assure proper positioning of the bobbin assembly relative to the magnet assembly in the telephone receiver. Acetal molding material has successfully been employed for manufacture of dual hinge bobbin assemblies in accordance with the present invention.

While but a single embodiment of the present invention has been shown it will be obvious to those skilled in the art that numerous modifications may be made without departing from the spirit of the present invention which shall be limited only by the scope of the claims appended hereto.

What is claimed is:

1. A dual bobbin assembly comprising: first and second spool like bobbin elements normally positioned parallel to each other, each including a first flange at a first end of said bobbin element and a second flange at a second end of said element; hinge means flexibly connecting said second flange of said first element to said second flange of said second element; and engaging means included in the exterior side of each of said second flanges; whereby said bobbin elements may be further manually positioned axi-symmetrically and releasably retained in said axi-symmetric position by said hinge means and said engaging means.

2. A dual bobbin assembly as claimed in claim 1 wherein: said engaging means of each of said bobbin elements includes a male projecting pin and female receiving means; said projecting pin on said first bobbin element adapted to engage said receiving means on said second bobbin element and said projecting pin on said second bobbin element adapted to engage said receiving means on said first bobbin element.

3. A dual bobbin assembly as claimed in claim 1 wherein: each of said bobbin element first flanges include a plurality of standoff posts.

4. A dual bobbin assembly as claimed in claim 1 wherein: said hinge means comprises a plurality of flexible hinge sections each connected between said second flange of said first element and said second flange of said second element.

5. A dual bobbin assembly as claimed in claim 4 wherein: each of said flexible hinge elements include wire guide means.

6. A dual bobbin assembly as claimed in claim 5 wherein:

said wire guide means each comprise a projection extending at right angles to said hinge.

7. The method of making a coil assembly which comprises:

providing a dual bobbin assembly comprising first and second bobbin elements normally positioned parallel to each other and each including a first flange at a first end of each element and a second flange at a second end of each element, and hinge means flexibly connecting said second flange of said first element to said second flange of said second element and engaging means included in the exterior side of each of said second flanges;

repositioning said first and second bobbin elements by bending said hinge elements to position said first and second bobbin elements axi-symmetrically;

temporarily connecting said second flange of said first element to said second flange of said second element by said engaging means;

winding a coil of insulated wire on at least said first bobbin section.

8. The method as set forth in claim 7 additionally including:

winding a coil of insulated wire on said second bobbin; said first and second coils being connected;

releasing said engaging means;

and repositioning said first and second bobbin elements parallel to each other.

* * * * *